US007021497B2

(12) United States Patent
Hara

(10) Patent No.: US 7,021,497 B2
(45) Date of Patent: Apr. 4, 2006

(54) DEVICE FOR COMPRESSING FLEXIBLE TUBES CONTAINING PASTES, CREAMS AND THE LIKE PROVIDED WITH A RECEPTACLE FOR STORING DENTAL FLOSS

(76) Inventor: Takehiro Hara, Trav. Araci, No. 102, Vila Gesuato, Braganca Paulista, Sao Paulo CEP12900-310 (BR)

( * ) Notice: Subject to any disclaimer, the term of this patent is extended or adjusted under 35 U.S.C. 154(b) by 349 days.

(21) Appl. No.: 10/622,829

(22) Filed: Jul. 21, 2003

(65) Prior Publication Data

US 2005/0029278 A1 Feb. 10, 2005

(51) Int. Cl.
*B65D 35/018* (2006.01)

(52) U.S. Cl. ..... 222/106; 132/314

(58) Field of Classification Search ..... 222/93, 222/95, 103, 106; 132/314
See application file for complete search history.

(56) References Cited

U.S. PATENT DOCUMENTS 1,487,215 A * 3/1924 Dial ..... 132/325
2,652,949 A * 9/1953 Martin ..... 222/95
4,778,082 A * 10/1988 Vitelle ..... 222/95
4,957,125 A * 9/1990 Yaneza ..... 132/309
5,330,077 A * 7/1994 Swanson ..... 222/95

* cited by examiner

*Primary Examiner*—Frederick Nicolas
*Assistant Examiner*—M A Cartagena
(74) *Attorney, Agent, or Firm*—Arent Fox PLLC

(57) ABSTRACT

A device for compressing flexible tubes containing pastes, creams and the like, provided with a receptacle for storing dental floss, making it easy to handle flexible tubes (2) for storing pasty or creamy products, thus providing the full utilization thereof thanks to a differentiated construction and design, wherein a device (1) inserted through its center gap (6) into the lower part of the flexible tube (2) and manually pushed toward the nozzle runs along and compresses the flexible body (2) to expel the product, said device (1) also being provided with a bevel (5) at one of the ends of its upper side, so that the handling thereof may cause a light displacement as it reaches the point wherein there is an accumulation of the product so that the device (1) is locked on the side edges of the flexible tube (2) after the product is expelled, and, because of such displacement, it is prevented from being pushed back, therefore becoming self-locked so that the next time the user uses same he/she will start dispensing same again by applying a slight pressure thereon, thus avoiding any waste and facilitating the use of pastes and creams.

1 Claim, 2 Drawing Sheets

DEVICE FOR COMPRESSING FLEXIBLE TUBES CONTAINING PASTES, CREAMS AND THE LIKE PROVIDED WITH A RECEPTACLE FOR STORING DENTAL FLOSS

DISCLOSURE OF THE INVENTION

The present specification is directed to an application for a utility model related to a functional device for compressing flexible tubes of dental pastes, creams and the like which is also provided with a receptacle for storing dental floss, forming a body in the shape of a straight bottom buckle the upper edge of which is diagonally beveled.

The body has a central hollow slot that runs from one side to the other side thereof so that said part may be inserted and go across the flexible tube, so that the user may expel the contents thereof in the amount desired by applying a slight pressure thereon, and, in view of its strategically diagonal bevel, the part is locked by being slightly misaligned or inclined in the flexible tube, in order to prevent same from being pushed back, therefore facilitating, after it is subjected to further pressures, the expulsion of the product until it is finished without any waste.

STATE OF ART

In view of today's needs, people are increasingly doing their personal hygiene away from their homes, either due to lack of time or because they have to cover long distances to go home—many times a must in big cities—and therefore the act of brushing or cleaning the teeth in the place they work is becoming a habit, or in the event the users are traveling.

In such situations, it is important that the tooth paste can be easily expelled from the tube, especially after its contents reaches half its capacity or more when, conventionally, the user must compress manually the body of the tube until he reaches the point provided with an internal volume and then may be able to expel the desired amount of product.

As to the use of dental floss, the conventional package brings about a number of difficulties with respect to the removal of the tip by means of which the dental floss will be pulled in order to be cut off to be finally passed through the teeth gaps of the teeth, what is sometimes, a non-hygienic procedure.

OBJECT OF THE PATENT

Having such issues in mind, the present object was developed, aiming at providing more comfort to the user when he/she brushes and cleans his/her teeth, by using a device that makes it easy to handle the flexible tube containing tooth paste and dental floss, allowing total exploitation of the related products, thanks to differentiated construction and design.

Therefore, a device was developed which, by being inserted through its central gap into the lower part of the flexible tube, is manually pushed toward the nozzle, thus running across the body of the tube and pressing same. Thus, as a pressure is applied to the walls that delimit the central gap of said device, the pasty product contained therein is expelled through the nozzle of the flexible tube.

Said device is provided with a bevel in one of the ends of its upper side, thus forming a larger area so that the handling thereof will cause naturally a slight displacement of the device when it reaches the point wherein there is an accumulation of product. Thus, after the expulsion, the device is locked on the side edges of the flexible tube because of such displacement.

Therefore, in view of being misaligned in the flexible body, the device becomes self-locked, thus being prevented from being pushed back, so that the next time the user uses the device he/she will apply a slight pressure to start expelling the product again from the previous point, so that he/she may replenish the tooth-brush in the case of a tooth-paste.

Of course the device could be provided in tubes that may contain other types of pasty products.

The device also has on its front side a cylindrical receptacle onto which the dental floss will be winded, which receptacle is protected by a cover, said dental cleaning element contained therein being pulled for use and then cut off by a lower blade to be used then.

Explained shortly, more details on the device can be seen in the accompanying drawings, wherein.

Figure 1:
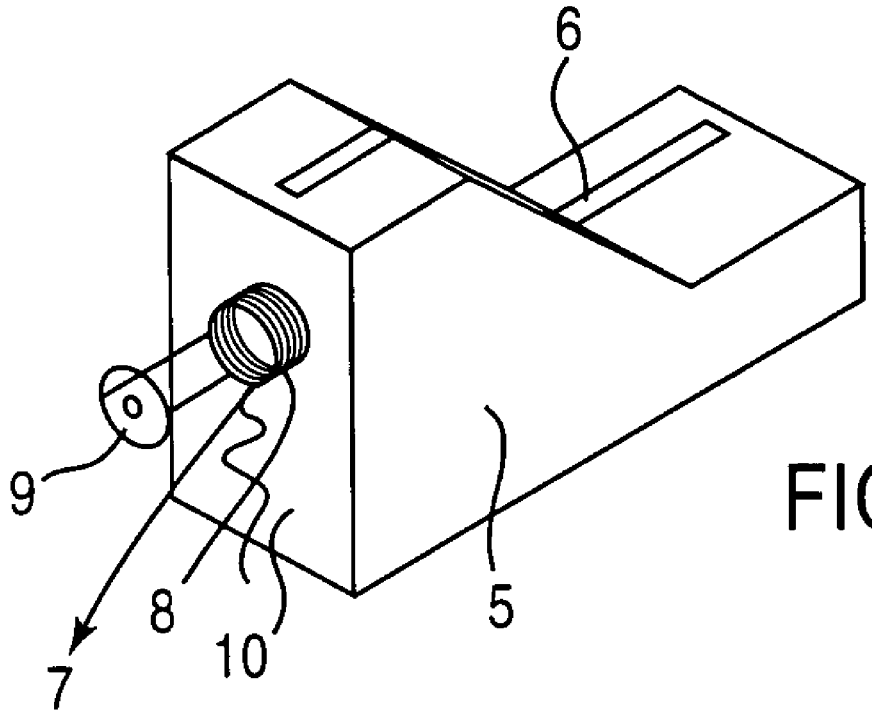
FIG. 1 is a side perspective view of the device.
Figure 2:
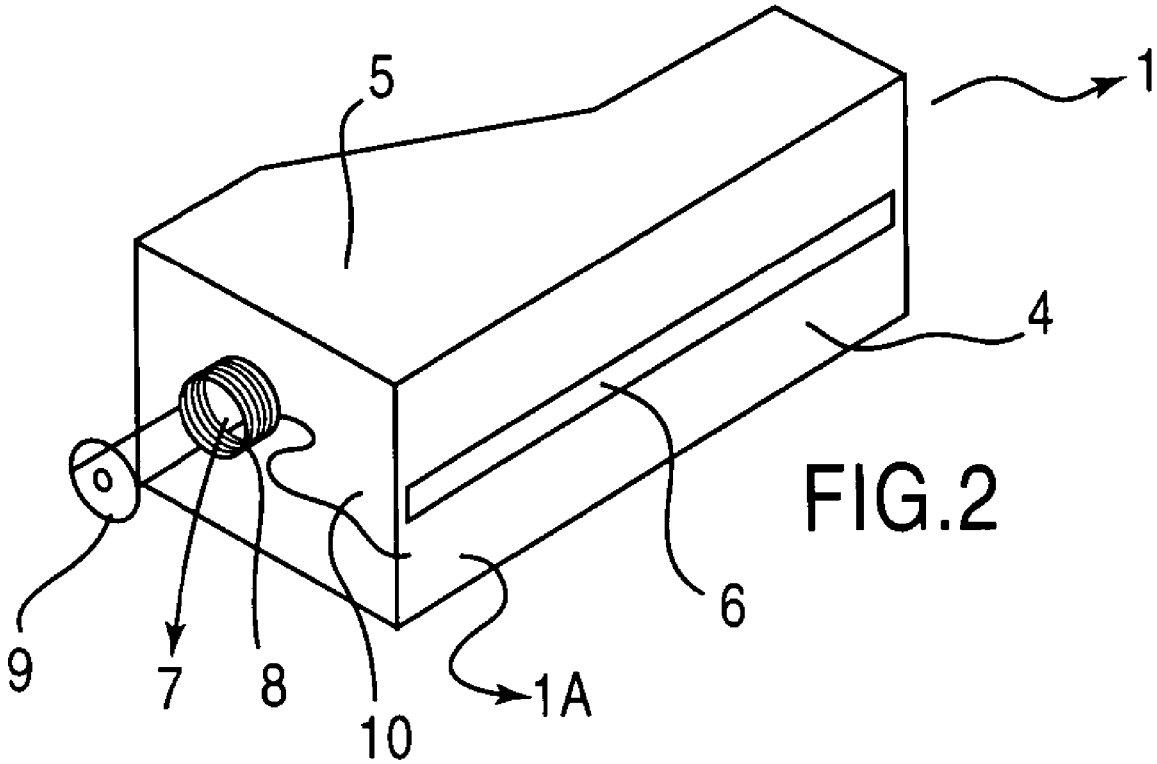
FIG. 2 is a bottom perspective view of the device.
Figure 3:
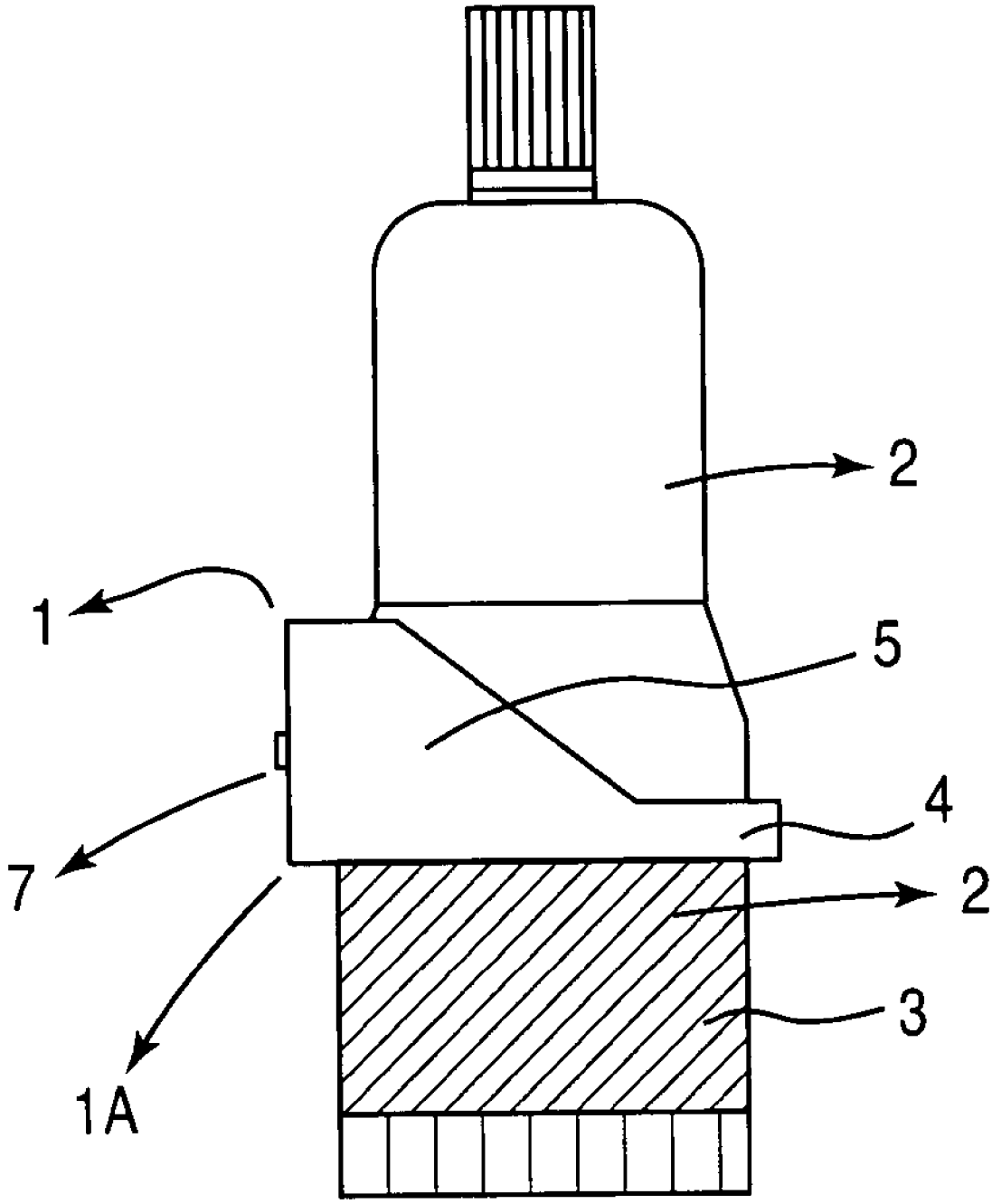
FIG. 3 is a view of the device applied to a flexible tube.

According to the illustrations and its details, the device for compressing flexible tubes containing pastes, creams and the like provided with a receptacle for storing dental floss, object of the present application for a utility model, is a device (1) for compressing flexible tubes (2) the purpose of which is to expel the products contained in the interior (3) thereof, such as creams and pastes, said device (1) being in the shape of a buckle (1A) having a straight bottom (4), the upper side of which being provided on one of its ends with a diagonally cut bevel (5), thus forming an end having a larger area.

The device (1) is hollow from its bottom (4) along a narrow central slot (6) that makes out a gap, occupying almost the whole extension of its body (1) from one side to the other.

In the front side, the device (1) is provided with an oval-shaped receptacle (7) for winding up the dental floss (8), said receptacle (7) also being provided with a cap (9) and a lower blade (10).

In such a construction, the device (1), by being manually held, is inserted through its slot or gap (6) and pushed toward the nozzle of said package (2) so that the pressure applied to said flexible body may cause the product contained therein to be expelled.

At the highest pressure point in the interior (2) of the tube, with the conformation provided by the larger area bevel (5) at this point, the device (1) tends to be pushed more fiercely toward said end (5), thus causing a slight side displacement thereto.

After the desired amount of product is expelled, the device (1) is then inclined naturally, being pushed by the inner walls of its slot (6) against the side edges of the body of the tube (2).

Such misalignment prevents the device (1) from being pushed back by the body of the tube (2), keeping same self-locked at the point it reaches the product contained therein, that is, always in a position wherein, after being pushed forward again, it causes the contents in the desired amount to be expelled and so on, quickly and without any waste, until all the product contained in the package (2) is removed therefrom.

The invention claimed is:

1. A device for compressing flexible tubes containing pastes, creams and the like, provided with a receptacle for storing dental floss, comprised of a device (1) for compressing flexible tubes (2), the purpose of which is to expel pasty and creamy products from its interior (3), said device (1) being characterized by having a buckle shape (1A) in its straight bottom (4), being provided in one of its ends with a diagonally cut bevel (5), forming an end having a larger area, said device (1) being hollow from its bottom (4) along a narrow central slot (6) that makes out a gap, occupying almost the whole extension of its body (1); in the front side, the device (1) is provided with an oval-shaped receptacle (7) for winding up the dental floss (8), said receptacle (7) also being provided with a cap (9) and a lower cutting blade (10).

* * * * *